US007325278B2

(12) United States Patent
Bocht

(10) Patent No.: US 7,325,278 B2
(45) Date of Patent: Feb. 5, 2008

(54) ALL-STEEL CARD CLOTHING FOR ROLLERS AND/OR DRUMS OF CARDERS OF CARDING MACHINES

(75) Inventor: Bernhard Bocht, Neubulach (DE)

(73) Assignee: Trützschler Card Clothing GmbH, Neubulach (DE)

( * ) Notice: Subject to any disclaimer, the term of this patent is extended or adjusted under 35 U.S.C. 154(b) by 84 days.

(21) Appl. No.: 10/536,255

(22) PCT Filed: Sep. 11, 2003

(86) PCT No.: PCT/EP03/10124

§ 371 (c)(1),
(2), (4) Date: Jan. 6, 2006

(87) PCT Pub. No.: WO2004/048654

PCT Pub. Date: Jun. 10, 2004

(65) Prior Publication Data

US 2006/0156516 A1 Jul. 20, 2006

(30) Foreign Application Priority Data

Nov. 25, 2002 (DE) ..... 102 54 918

(51) Int. Cl.
*D01G 15/84* (2006.01)

(52) U.S. Cl. ..... 19/114

(58) Field of Classification Search ..... 19/98, 19/114

See application file for complete search history.

(56) References Cited

U.S. PATENT DOCUMENTS

| | | | | |
|---|---|---|---|---|
| 2,832,098 | A | 4/1958 | Mee | |
| 4,653,152 | A * | 3/1987 | Wada | 19/114 |
| 4,964,195 | A * | 10/1990 | Hollingsworth | 19/114 |
| 5,423,176 | A * | 6/1995 | Stahlecker et al. | 57/408 |
| 5,566,541 | A * | 10/1996 | Stahlecker et al. | 57/408 |
| 6,035,493 | A * | 3/2000 | Carlton | 19/98 |

FOREIGN PATENT DOCUMENTS

| | | |
|---|---|---|
| CH | 414 410 | 5/1966 |
| DE | 101 08 140 | 8/2002 |
| EP | 1 099 783 | 5/2001 |

* cited by examiner

*Primary Examiner*—Shaun R. Hurley
(74) *Attorney, Agent, or Firm*—Venable LLP; Robert Kinberg

(57) ABSTRACT

The present invention relates to an all-steel card clothing for rollers and/or cylinders of carding machines. Carding machines comprise rollers which are configured to actively take over raw fiber materials from rollers arranged upstream in work direction. Therefore, such card clothings have a relatively large front angle. The problem is that the stability of the card clothings suffers. According to the invention, the teeth have a head angle of >85° in order to solve this problem. The length of the head surface extending at said angle from the tooth tip to the tooth back corresponds to at least ¼ of the length of the tooth pitch. This achieves a considerably more stable card clothing while maintaining the high carding quality.

20 Claims, 3 Drawing Sheets

ALL-STEEL CARD CLOTHING FOR ROLLERS AND/OR DRUMS OF CARDERS OF CARDING MACHINES

BACKGROUND

The present invention relates to all-steel card clothings for rollers and/or cylinders of cleaners, or carding machines, which rollers or cylinders have a higher circumferential speed than rollers arranged upstream in the fiber flow direction, the all-steel card clothing having teeth with a positive front angle of ≧0°.

The rollers in question are e.g. licker-ins, strippers or transfer rollers on carding machines, and the cylinders of a carding machine. Said rollers or cylinders actively take over raw fiber material with the front edge of the front angle of the teeth of the corresponding all-steel card clothing.

The problem in such card clothings is that positive front angles are needed for ensuring an easy fiber take-over. This, however, tends to make the tooth tip leaner, which makes said card clothings more sensitive during assembly and also during resharpening. Moreover, impurities or dirt in the raw fiber material may be impaled more easily.

SUMMARY

It is therefore the object of the present invention to provide a all-steel card clothing of the above-indicated type which eliminates the drawbacks observed in the prior art while maintaining good take-over properties.

This object is achieved in an all-steel card clothing of the above-indicated type in that the teeth have a head angle which is >85°, preferably >87°, the length of the head surface extending at said angle from the tooth tip to the tooth back being at least 15% of the length of the tooth pitch.

The advantages resulting from such a tooth shape are that a clogging of the card clothings is prevented on the one hand and that although the card clothing still shows the aggressiveness or activity needed for carding, it is obtuse to contamination. Furthermore, the teeth of the all-steel card clothing are more stable and less sensitive during assembly and resharpening. Moreover, in the case of soiled raw fiber materials, such as cotton, an impaling of foreign matter is prevented. As a result, the card clothing need not be cleaned so often. On the whole, it has been found that apart from the advantages to be expected the carding quality is also improved.

According to a preferred embodiment the head angle of the tooth is 90°. This has the effect that even after a regrinding of the card clothing the same conditions prevail on all teeth, which in turn improves the carding quality.

Moreover, it is particularly preferred when the length of the head surface is at least 25% of the tooth pitch.

It is further preferred when the length of the head surface is at least three times, preferably five times, the width thereof. Finally, it has been found to be advantageous when the length of the head surface is greater than or equal to half the tooth height, measured from the tooth base to the tooth tip. This yields a relatively low card clothing which surprisingly creates favorable carding conditions. It is particularly preferred when the length of the head surface corresponds to the tooth height.

Finally, it is also advantageous when the tooth back adjacent to the head surface encloses an angle between 20° and 30°, preferably 25°, with the subsequent tooth front. This opening angle between tooth back and tooth front tends to be smaller than in the prior-art card clothings. It is however adequate for ensuring an easy take-over of the fibers from the roller arranged upstream in the work direction.

The above-described all-steel card clothing is particularly well suited for cylinders of cotton carding machines, so-called high-performance carding machines, having a circumferential cylinder speed of more than 1500 m/min and a cylindrical all-steel card clothing having a total height of less than 3 mm and a base width of less than 0.7 mm. Therefore, particular protection is sought for such a cotton carding machine equipped with an all-steel card clothing according to the invention.

BRIEF DESCRIPTION OF THE DRAWINGS

Embodiments of the present invention will now be explained in more detail with reference to a drawing, in which.

DETAILED DESCRIPTION

Figure 1:
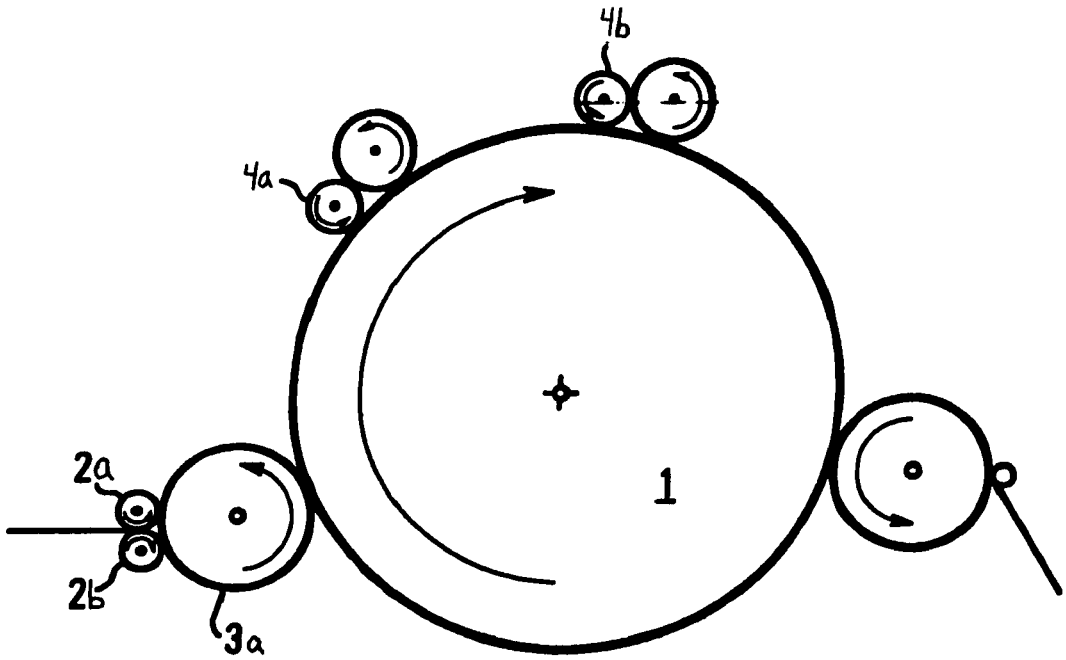
FIG. 1 is a schematic illustration of a carding machine in a side view.

FIG. 1 is a schematic illustration showing a carding machine comprising a cylinder 1, feed rollers 2*a*, 2*b*, licker-in 3 and strippers 4*a*, 4*b*. The circumferential rotational direction of the rollers is shown in FIG. 1 by corresponding arrows.

The card clothing described in the following refers to such rollers or cylinders that actively take over fibers from rollers arranged upstream in the work direction. These are by way of example the licker-in 3, the strippers 4*a*, 4*b*, and, particularly, cylinder 1 in the illustration shown in FIG. 1.

Figure 2:
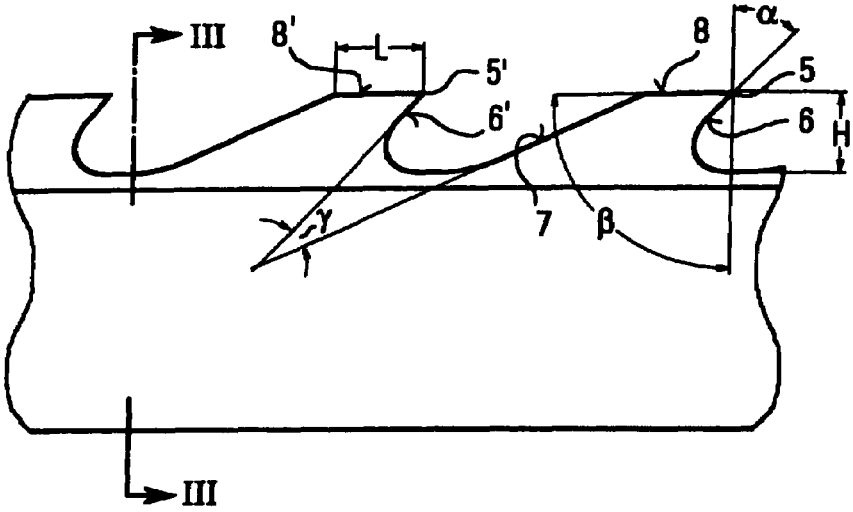
FIG. 2 shows the tooth geometry of an all-steel card clothing according to a first embodiment.
Figure 3:
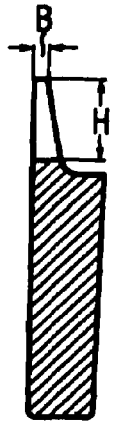
FIG. 3 is a sectional view of the illustration of FIG. 2 along line III-III.

FIG. 2 only shows in sections a sawtooth wire of an all-steel card clothing, as is provided for the cylinder shown in FIG. 1. This is a sawtooth wire having a total height of 2 mm and a tooth pitch, measured from the tooth tip 5 to the next one 5', of 1.7 mm. The front angle α of the tooth front 6 measured relative to the vertical is 40° in the illustrated embodiment. In contrast to the formerly known all-steel card clothings, the tooth back 7 does not directly follow the tooth tip. Rather, a head surface 8 is first provided. The angle of the head surface β, again measured relative to the vertical, is 87° in the embodiment shown in FIG. 2. The length L of the head surface 8 is 0.5 mm, its width B (cf. FIG. 3) is 0.07 mm. The tooth height H, measured from the tooth base to the tooth tip 5, is slightly less than 0.5 mm.

The angle γ enclosed by the tooth front 6 and the tooth back 7 is 24° in the illustrated embodiment.

Figure 4:
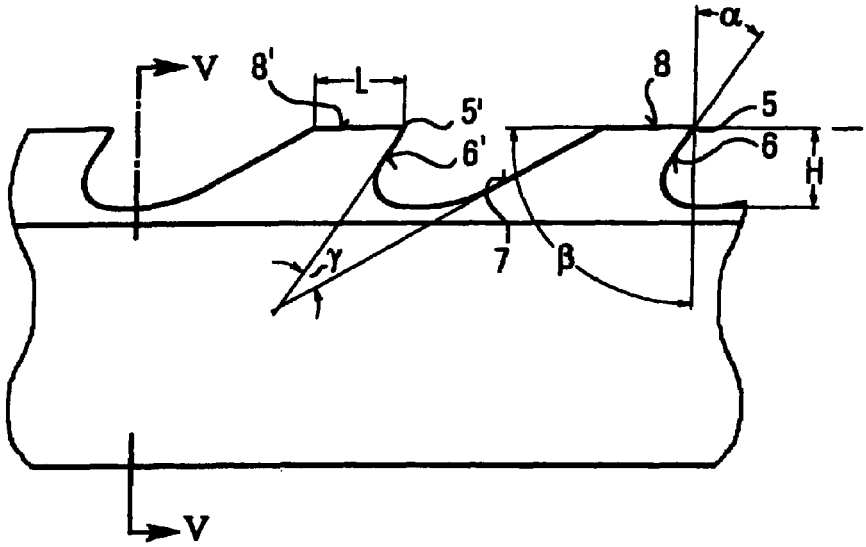
FIG. 4 shows the geometry of an all-steel card clothing according to a further embodiment.
Figure 5:
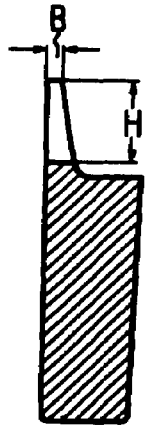
FIG. 5 is a sectional view taken along line V-V of FIG. 4.

FIGS. 4 and 5 show a further variant of a sawtooth wire for an inventive all-steel card clothing. Identical and similar components are provided with the same reference numerals as in the preceding embodiment.

In contrast to the former embodiment, the distance between tooth tip 5 and neighboring tooth tip 5' is just 1.5 mm. The front angle α is just 30°. The angle γ enclosed between tooth front 6 and tooth back 7 is 25° in this embodiment.

Operation and function of the above-described embodiments shall now be explained in more detail in the following.

The two embodiments do not fundamentally differ from each other. The sawtooth wire shown in FIG. 2 has, however, a larger front angle which is in principle favorable for a more active fiber take-over. Of importance to the two variants is, however, that at a relatively small tooth height a long head surface is provided that is almost not inclined and therefore gives the tooth tip and the whole card clothing an enhanced stability. Apart from these advantages, however, it should be emphasized that the tooth geometry is virtually not changed even after regrinding of the card clothing, so that virtually the same conditions prevail on all teeth on the one hand and the carding quality does not change even after grinding of the card clothings on the other hand.

The card clothings are mounted in the conventional way.

The invention claimed is:

1. A carder comprising:

a cylinder configured to have a circumferential cylinder speed of greater than 1500 m/min; and a cylindrical all-steel card clothing having a total height of less than 3 mm and a base width of less than 0.7 mm, the card clothing comprising teeth each of which is defined by a tooth front, a tooth back, a tooth tip, a tooth head surface, and a tooth base, wherein the tooth front of each of the teeth defines a positive front angle ($\alpha$) of greater than or equal to 0° as measured from vertical, wherein the head surface of each of the teeth defines a head angle ($\beta$) which is greater than 85° as measured from vertical and a length of the head surface extending at said head angle ($\beta$) from the tooth tip to the tooth back is at least 15% of a length of a tooth pitch defined by the distance between the tooth tips of adjacent teeth.

2. The carder according to claim 1, wherein the head angle ($\beta$) of the tooth is 90°.

3. The carder according to claim 1, wherein the length of the head surface is at least 25% of the tooth pitch.

4. The carder according to claim 1, wherein the length of the head surface is at least three times a width of the head surface.

5. The carder according to claim 1, wherein the length of the head surface is greater than or equal to half the height of each of the teeth, wherein the height of each of the teeth is measured from the tooth base to the tooth tip.

6. The carder according to claim 1, wherein the tooth back adjacent to the head surface of each of the teeth defines an angle ($\gamma$) between 20° and 30° with the subsequent tooth front.

7. The carder according to claim 1, wherein a height of each of the teeth is less than or equal to 0.5 mm.

8. The carder according to claim 1, wherein the head angle ($\beta$) is greater than 87°.

9. The carder according to claim 4, wherein the length of the head surface is at least five times the width of the head surface.

10. The carder according to claim 6, wherein angle ($\gamma$) is about 25°.

11. A card clothing having a total height of less than 3 mm and a base width of less than 0.7 mm, the card clothing comprising:

a plurality of teeth each of which is defined by a tooth front, a tooth back, a tooth tip, a tooth head surface, and a tooth base, wherein the tooth front of each of the teeth defines a positive front angle ($\alpha$) of greater than or equal to 0° as measured from vertical, wherein the head surface of each of the teeth defines a head angle ($\beta$) which is greater than 85° as measured from vertical and a length of the head surface extending at the head angle ($\beta$) from the tooth tip to the tooth back is at least 15% of a length of a tooth pitch defined by the distance between the tooth tips of adjacent teeth.

12. The card clothing according to claim 11, wherein the head angle ($\beta$) of the tooth is 90°.

13. The card clothing according to claim 11, wherein the length of the head surface is at least 25% of the tooth pitch.

14. The card clothing according to claim 11, wherein the length of the head surface is at least three times a width of the head surface.

15. The card clothing according to claim 11, wherein the length of the head surface is greater than or equal to half the height of each of the teeth, wherein the height of each of the teeth is measured from the tooth base to the tooth tip.

16. The card clothing according to claim 11, wherein the tooth back adjacent to the head surface of each of the teeth defines an angle ($\gamma$) between 20° and 30° with the subsequent tooth front.

17. The card clothing according to claim 11, wherein a height of each of the teeth is less than or equal to 0.5 mm.

18. The card clothing according to claim 11, wherein the head angle ($\beta$) is greater than 87°.

19. The card clothing according to claim 14, wherein the length of the head surface is at least five times the width of the head surface.

20. The card clothing according to claim 16, wherein angle ($\gamma$) is about 25°.

* * * * *